US007758202B2

(12) United States Patent
Krieger

(10) Patent No.: US 7,758,202 B2
(45) Date of Patent: Jul. 20, 2010

(54) CASTER-BORNE STEP STOOL WITH POSITIONABLE LIGHTS AND RECHARGEABLE BATTERY

(76) Inventor: John M. Krieger, 351 Graham Rd., Cuyahoga Falls, OH (US) 44223

( * ) Notice: Subject to any disclaimer, the term of this patent is extended or adjusted under 35 U.S.C. 154(b) by 0 days.

(21) Appl. No.: 11/581,998

(22) Filed: Oct. 18, 2006

(65) Prior Publication Data

US 2008/0094826 A1 Apr. 24, 2008

(51) Int. Cl.
*A47C 12/00* (2006.01)
*F21V 33/00* (2006.01)

(52) U.S. Cl. ..... 362/131; 362/134; 362/283; 108/23

(58) Field of Classification Search ..... 362/283, 362/134, 228, 131, 132; 108/23; 312/223.5, 312/235.1; 297/217.6, 461–462; 248/129; 280/43, 43.24, 87.051
See application file for complete search history.

(56) References Cited

U.S. PATENT DOCUMENTS 4,029,954 A * 6/1977 Moyer ..... 362/183
4,311,208 A * 1/1982 Macrorie et al. ..... 182/18
4,766,525 A * 8/1988 Loughlin ..... 362/183
5,083,241 A * 1/1992 Foster ..... 362/33
5,570,948 A * 11/1996 Menke et al. ..... 362/191
5,584,546 A * 12/1996 Gurin et al. ..... 312/200
6,464,371 B2 * 10/2002 Bender ..... 362/127
6,562,509 B1 * 5/2003 Eggert ..... 429/96
6,642,667 B2 * 11/2003 Avis ..... 315/200 A
6,857,756 B2 * 2/2005 Reiff et al. ..... 362/184
7,174,994 B1 * 2/2007 Coffield et al. ..... 182/129

FOREIGN PATENT DOCUMENTS

GB 2171596 A * 9/1986

* cited by examiner

*Primary Examiner*—Sandra L O'Shea
*Assistant Examiner*—Leah S Lovell
(74) *Attorney, Agent, or Firm*—Renner, Kenner, Greive, Bobak, Taylor & Weber

(57) ABSTRACT

A step stool with positionable lights and a rechargeable battery is carried upon retractable casters for suitable positioning and utility. A motion and timer switch is interposed between the battery and the positionable lights to allow the positionable lights to be illuminated only for a fixed period of time following movement of the step stool. The lights may be positionable as by adjustable brackets or by a cord reel assembly. The step stool has contact bands thereabout that are adapted for engagement with contacts in a charging station that is specifically configured to receive the step stool. Receipt of the step stool by the charging station activates a battery charger that serves to charge the battery of the step stool thereafter. A solenoid switch disconnects the lights of the step stool upon commencement of the charging operation.

14 Claims, 3 Drawing Sheets

FIG.-2
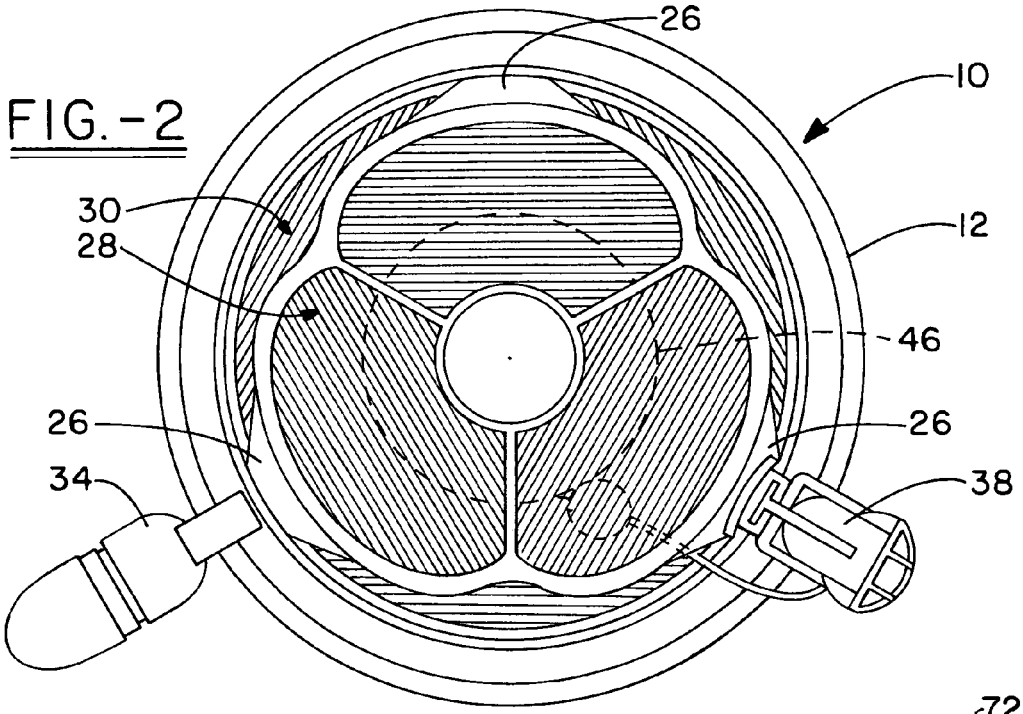
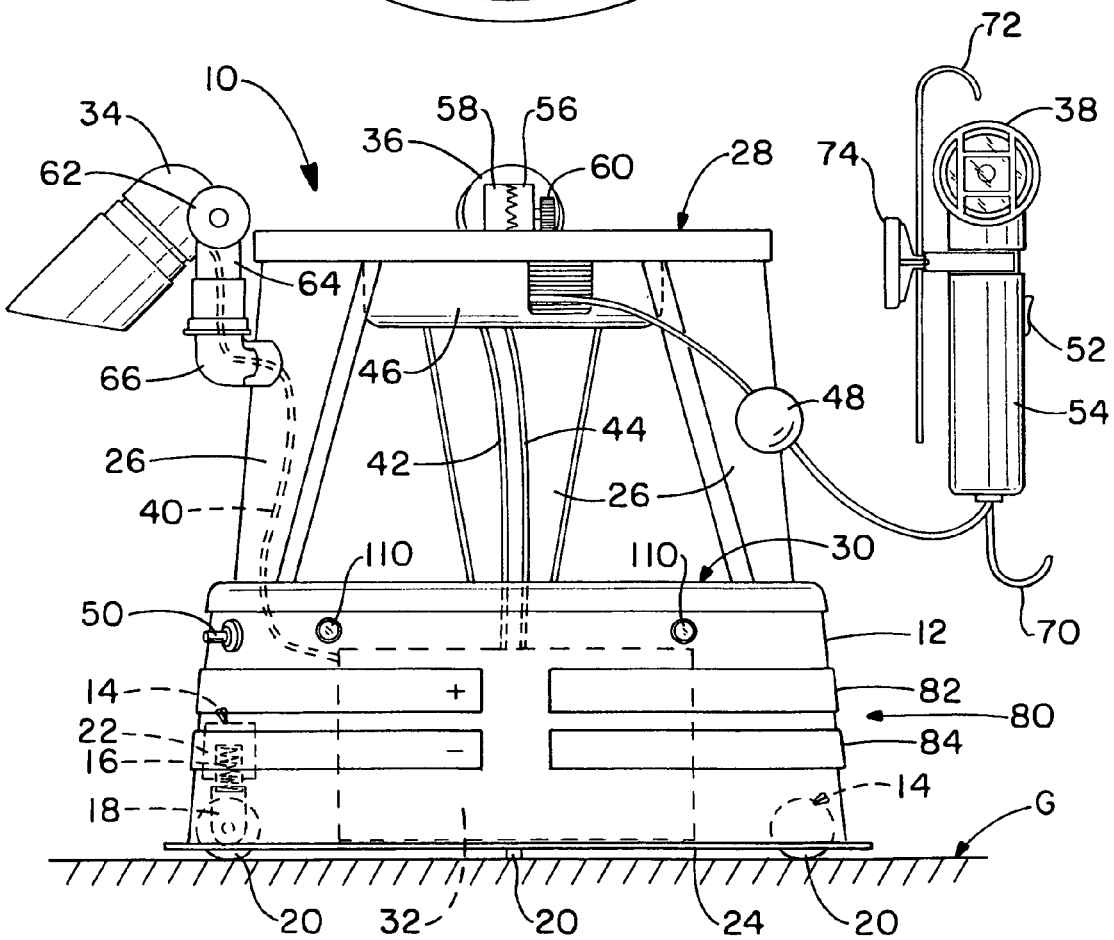
FIG.-1

CASTER-BORNE STEP STOOL WITH POSITIONABLE LIGHTS AND RECHARGEABLE BATTERY

TECHNICAL FIELD

The present invention generally resides in the art of step stools and lighting devices. In particularly preferred embodiments, the present invention resides in the art of caster-borne step stools and lighting devices.

BACKGROUND OF THE INVENTION

Step stools are well-known and are employed for various reasons in both domestic and industrial settings. In the broadest sense, a step stool can be virtually any readily portable physical structure that can rest on a horizontal or ground surface and provide a support surface raised from the ground surface at a distance suitable for stepping up to the support surface. There are many physical structures that can provide such a support surface.

To improve the utility of the basic step stool, many manufacturers have designed their step stools with auxiliary features. For instance, some step stools provide an intermediate support surface that is maintained below the main support surface. Such an intermediate support surface could be used as an aid to reaching the higher elevated main support surface, or the intermediate support surface could serve as a platform of support when the additional height provided by the main support surface is not needed. Some step stools are designed to fold to a storage position to increase portability and facilitate storing the stool. Yet others include tool box type compartments to increase the utility of the step stool. Clearly, in the step stool arts, there is a drive to increase the utility of the step stool so that it does more than simply provide an elevated support surface to stand upon.

A particularly desirable type of step stool, especially in industrial settings, includes retractable casters. The step stool rides on spring-loaded casters, wherein the springs are sufficiently strong to force the base of the step stool off of the ground surface so that the step stool may ride on the casters, but are sufficiently weak so that, when an individual steps onto or sits upon the step stool, the lift of the springs is overcome and the base of the step stool engages the ground surface to remain stationary and provide a stable support. Such step stools may be moved simply by pushing them along the ground with one's foot, eliminating the need to bend down and pick up the step stool to place it where it is needed. A step stool of this type is produced by Cramer, Inc., under the brand name Kik-Step®. In industrial settings, such a step stool can be kicked around the work area, allowing the worker to carry additional needed items in his hands.

In many industrial or service settings, step stools are employed to aid a worker in reaching and working on a workpiece. For example, a mechanic may employ a step stool to stand on to work on portions of a car supported on a hydraulic lift. The mechanic may choose to sit on the stool while working on other parts of the car, such as the wheels and brakes, with the car only slightly elevated on the lift. In any event, for the example given, the need for additional or focused light on the work area of the car is always problematic. The present invention seeks to improve the common step stool for such applications, although it will be appreciated that the applications for the step stool disclosed herein are not limited to such industrial settings. Moreover, the invention herein is also directed to transportable and positionable lighting devices to illuminate work areas.

SUMMARY OF THE INVENTION

The present invention seeks to increase the utility of the common step stool. More particularly, the present invention incorporates at least one light source into a step stool design. In particularly preferred embodiments, the light source is powered by a rechargeable power source retained within the step stool. In yet other embodiments, the rechargeable power source can be recharged at a charging station. In particularly preferred embodiments in accordance with the best mode of this invention, the step stool rides on casters and may simply be rolled along the ground surface into the charging station. The step stool may also be rolled into a desired location, and the light adjusted, so that adequate light is available for the area being worked upon, while providing a surface for sitting or standing, as desired.

Thus, the present invention provides a step stool comprising a base, a support surface, a light source, and a rechargeable power source retained within the base and powering the light source.

In accordance with a particular embodiment, the light source is secured to the step stool in a manner that permits selective positioning of the direction of illumination provided by the light source. In other embodiments, multiple light sources are provided, preferably with each being selectively positionable to change the direction of illumination.

In some embodiments, the lights are enabled by movement of the step stool, and remain so enabled for a set period of time in the absence of subsequent movement.

In some embodiments, the rechargeable power source retained within the base can be recharged by contacting external charging contacts on the step stool with complimentary charging structures at a charging station. In particularly preferred embodiments, these recharging means may be employed without the need for positioning the step stool relative to the charging station in a specific mating orientation.

In certain embodiments, the lights are disabled during any period of recharging of the power source.

In other embodiments, the step stool feature of the invention is abated, and the invention is directed to a transportable lighting device for illuminating work areas.

BRIEF DESCRIPTION OF THE DRAWINGS

For a complete understanding of the objects, embodiments and structural features of the present invention, reference should be made to the following detailed description and accompanying drawings wherein, FIG. 1 is an elevational view of a step stool in accordance with the present invention;

FIG. 2 is a top view thereof;

PREFERRED EMBODIMENT FOR CARRYING OUT THE INVENTION

Figure 3:
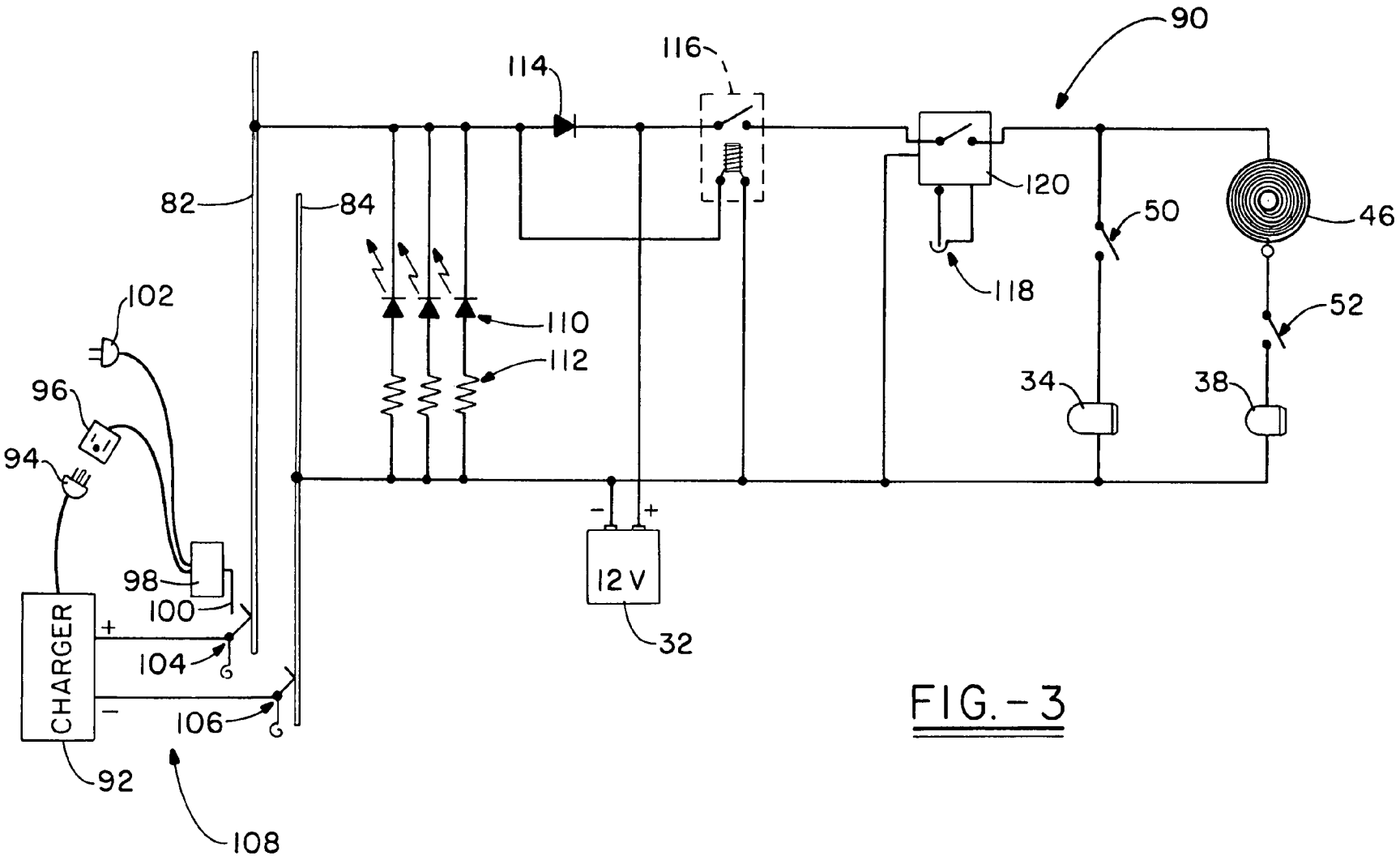
FIG. 3 is a circuit diagram showing the various elements of the step stool and charging station as they may be electrically interconnected.

Referring now to FIGS. 1 and 2, a preferred embodiment for a step stool in accordance with this invention is shown and designated by the numeral 10. FIG. 2 is slightly different than FIG. 1 in that a particular light source has been removed in FIG. 2. It will be appreciated that this helps demonstrate that the present invention is concerned with the provision of at least one, and not necessarily two, three, or more light sources in a step stool.

Step stool 10 includes base 12, which is elevated off of ground surface G and supported by spring-loaded retractable casters 14. Generally, at least three casters 14 would be provided, to effect a stable three-point support system. In the present invention, base 12 is circular, and three casters 14 are positioned at points of an equilateral triangle to provide adequate support. Additional casters may be employed, if desired, or if base 12 takes a different configuration.

Retractable casters are well known, and include biasing means 16 secured between the axle brackets 18 for wheels 20 and a stationary caster support 22 secured to base 12. Biasing means 16 exerts a force on axle bracket 18 and, thus, wheel 20, to lift base 12 on stationary caster support 22, to raise bottom edge 24 of base 12 off of the ground surface G. Thus, base 12, and the entire step stool 10, can freely ride on the ground surface on retractable casters 14. However, when sufficient force is applied downwardly on base 12, the force of biasing means 16 is overcome, and bottom edge 24 contacts ground surface G, making step stool 10 stationary so long as the downward force on step stool 10 remains. Such a step stool may be moved to a desired location simply by kicking or pushing it along the ground, allowing it to roll on the retractable casters. This function is particularly useful in an industrial or shop setting. Additionally, it is particularly useful in the present invention, wherein additional elements added to the step stool increase its weight beyond that which is practical for carrying the step stool to the desired location.

A plurality of supports 26 extend upwardly from base 12 to a primary support surface 28, and maintain primary support surface 28 above and substantially parallel to ground surface G at a height that is suitable for common step stool embodiments. The desired height for primary support surface 28 may be tailored to any desirable height for a given step stool, and the present invention is not limited to or by any particular dimensions. In this particular embodiment, supports 26 extend between primary support surface 28 and intermediate support surface 30, which may be considered as the top surface of base 12. Intermediate support surface 30 can serve as an intermediate step for accessing primary support surface 28, or may serve as the support surface employed when the extra height offered by supports 26 and primary support surface 28 is not needed.

Base 12 houses a battery 32 that serves to power light sources. In the embodiment of FIG. 1, three light sources are shown, including first light source 34, second light source 36 (not shown in FIG. 2) and remote light source 38. Each of these light sources is electrically connected to battery 32 by appropriate wiring. The wires associated with first and second light sources 34 and 36 are designated by the numerals 40 and 42, respectively. Remote light source 38 is connected to battery 32 through wire 44. Before connecting to light source 38, wire 44 winds around a retractable spool 46 so that light source 38 may be extended away from step stool 10 by pulling a desired length of wire 44 off of retractable spool 46. Retractable spool 46 is preferably configured to retract automatically, as known in the spool arts, and stopper 48 is provided on wire 44 between light source 38 and spool 46 to limit the extent to which wire 44 is drawn into spool 46. A separate switch, such as switch 50, is associated with each light source. Here, switch 50 is shown associated with light source 34, and this switch serves to turn light source 34 on and off. A similar switch would be provided for light source 36. Light source 38 carries a switch 52 on a handle portion 54 thereof.

Light sources such as light sources 34 and 36 may be secured to step stool 10 in fixed position and orientation, but may also be secured to step stool 10 in a manner that permits selective positioning of the direction of illumination provided by the light sources. In FIG. 1, it can be seen that light source 36 is secured to a movable toothed cam 56 that rotates relative to and selectively engages stationary tooth cam 58. The teeth of these respective cams are caused to engage each other through the tightening of bolt 60. Bolt 60 may be loosened so that the teeth on movable tooth cam 56 may be disengaged from the teeth on stationary tooth cam 58 and light source 36 may be pivoted around the axis of cams 56, 58. When the desired radial position is achieved, bolt 60 may be tightened to re-engage the teeth of the cams and secure light source 36 in a desired position. Thus, the interaction of cams 56 and 58 allows one to reorient the direction of illumination of light source 36 in a first, here vertical, plane. Light source 34 is secured to step stool 10 through a similar movable cam, stationary cam, and bolt mechanism, designated by the numeral 62 in FIG. 1. The cam and bolt mechanism 62 is secured to a movable post 64 that rides on and rotates relative to a support post 66 that is secured to step stool 10 at the support 26 shown. Wire 40 feeds up along support 26 and into support post 66 and movable post 64. It will be appreciated that movable post 64 rotates relative to support post 66 to reorient the direction of illumination of light source 34 in a second plane that is substantially normal to the plane of movement established by cam and bolt mechanism 62. Together, movable post 64 and cam and bolt mechanism 62 allow light source 34 to be positioned to direct its illumination in almost any given direction.

Remote light source 38 preferably includes at least one hook 70 for hanging remote light source 38 at a desired location. In the embodiment shown, light source 38 further includes a second hook 72, provided for the same reason. In the particularly preferred embodiment, supports 26 include at least a metal portion, and light source 38 includes a magnet 74 that can be used to secure light source 38 to step stool 10, at that metal portion. It will be appreciated that, as shown, light source 38 is a retractable work light or "trouble light."

As mentioned above, the invention also contemplates the inclusion and utilization of fixed lights in place of, or in addition to, adjustable lights. In that regard, lights 34, 36 of the unit 10 may be fixed as to position and orientation. Any number of lights may be employed as a bank of fixed lights to provide illumination to a desired work region or area. A single fixed light may be used where the routinely encountered work area is specific and finite, while a bank of such lights may be used where a flood light effect is desired.

As mentioned, base 12 retains battery 32, for powering the various light sources that may be employed in accordance with this invention. Preferably, battery 32 is rechargeable, particularly without having to remove battery 32 from step stool 10. This is achieved by operatively connecting battery 32 to external charging contacts on step stool 10. Here, as shown in FIGS. 1 and 3, external charging contacts are generally shown and designated by the numeral 80. External charging contacts 80 include a positive conductive band 82 and a negative conductive band 84.

Figure 4:
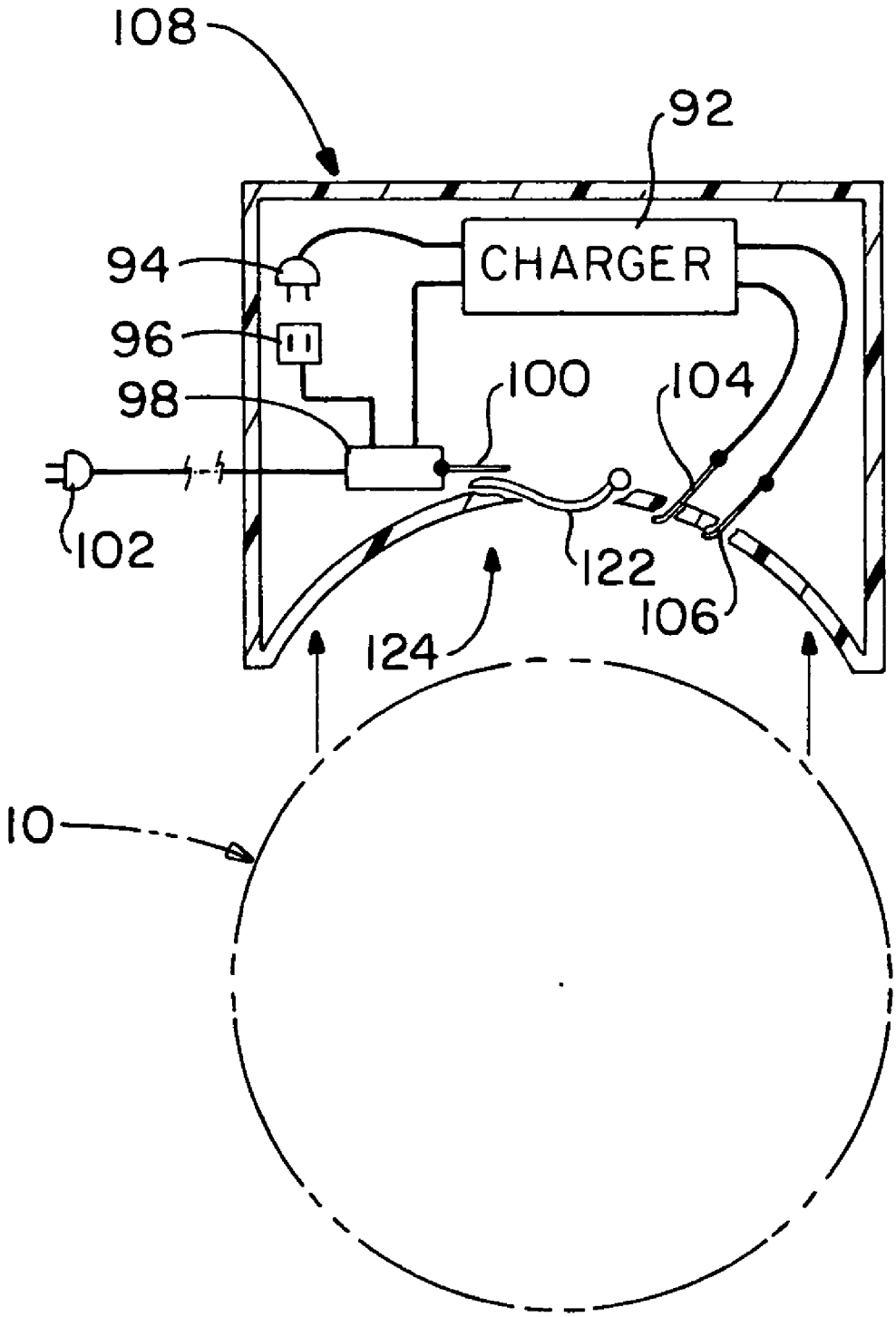
FIG. 4 is a general schematic of a charging station for receiving the step stool for recharging the step stool's battery.

With reference now to FIGS. 3 and 4, an appreciation can be obtained of the circuitry and associated elements of the step stool 10. As shown therein, a charging station 108 is provided to nestingly receive the step stool 10 to effect the charging of the battery 32. A charger 92 is received within the charging station 108, and may be of any of various types, suitable for recharging a battery. Typically, the charger 92 would comprise an AC to DC converter suitable for providing a charging current to batteries of the type employed. The charger 92 has an electrical plug 94 adapted to engage a jack 96 that is interconnected with a wall plug 102 through an appropriate contact switch 98 having a switch arm 100. Those skilled in the art will readily appreciate that the wall plug 102 is adapted for connecting to any appropriate AC power source. Actuation of the switch arm 100 closes the switch 98 to activate the charger 92, as will be readily understood by those skilled in the art.

The positive output terminal of the charger 92 is connected to a spring biased contact 104, while the negative terminal of the charger 92 is connected to a spring biased terminal 106. The terminals 104, 106 are positioned to make contacting engagement with respective positive and negative conductive bands 82, 84 of the charging contacts 80 that are circumferentially provided about the base 12 of the step stool 10. Accordingly, when the step stool 10 is nestingly received in the arcuate opening 124 of the charging station 108, the contacts 104, 106 are positioned to respectively engage the bands 82, 84 which, as shown in FIG. 3, are respectively provided in contact with the positive and negative terminals of the battery 32.

With particular reference now to FIG. 3, an appreciation of the battery charging and operational circuitry 90 of the step stool 10 can be obtained. As shown, a series of light emitting diodes 110, interconnected with respective current limiting resistors 112, are interposed between the bands 82, 84 and positive and negative terminals of the battery 32. Accordingly, because of the presence of the blocking diode 114, the light emitting diodes 110 illuminate only when the step stool 10 is nestingly received by the charge station 108 such that the charger 92 is activated to place a voltage potential across the bands 82, 84 and, accordingly, across the terminals of the battery 32. The light emitting diodes 110 are, as shown in FIG. 1, uniformly spaced about the periphery of the base 12 of the step stool 10 for ease of observation. Accordingly, the user of the step stool 10 can visually determine that the battery 32 is being recharged.

A solenoid switch 116 is interposed across the bands 82, 84 such that, in the charging mode, the solenoid switch 116, which is a normally closed switch, is opened to disconnect power to the lights 34, 38 as shown in FIG. 3. Accordingly, while the battery 32 is being charged, there is assurance that the battery is not being drained by the lights, which are disabled by the switch 116.

Interconnected across the terminals of the battery 32 is a motion switch 118 and a timer switch 120. The motion switch 118 is closed upon sudden movement of the step stool 10 and serves to apply power to the timer switch 120. Accordingly, when a user moves the step stool 10, the motion switch 118 actuates the timer switch 120 to begin a time period of, for example, 15 minutes. The timer switch 120 stays closed for that period of time. If no further movement is made of the step stool 10 during that period of time, the switch 120 opens at the end of that time period, preventing the user from inadvertently leaving any of the lights on for a substantial period of time while they are not required, thus draining the battery 32. Any appreciable movement of the step stool 10, however, serves to actuate the motion switch 18 and reset the timer switch 120, such that the lights 34, 38 are available as needed. In the event the lights are left on for a period of time sufficient for the timer switch 120 to time out and open, any jarring or movement of the step stool 10 will cause the motion switch 118 to actuate and reset the timer switch 120 to again enable the lights by closing the line of power to the lights.

It will be appreciated, as shown in FIG. 3, that the light 34 has an associated switch 50, while the trouble light 38 has an associated switch 32 and cord reel 46. In the preferred embodiment, additional lights, such as the light 36, may also be employed. However, for purposes of simplicity, only the lamp 34 and associated switch 50 has been shown. Additional lights, such as the light 36 and associated switch can be place in parallel with the light and switch 34, 50, as will readily be appreciated by those skilled in the art.

As shown in FIG. 4, the charging station 108 has an arcuate opening 124 of a curvature consistent with the base 12 of the step stool 10, and with the spring biased contacts 104, 106 extending in alignment with the respective bands 82, 84, about the base 12 of the stool 10. Also received within the arcuate opening 124 is a spring loaded arm 122 which is actuated by the base 12 when it is pushed into the opening 124. The spring loaded arm 122 is positioned to make contacting engagement with the contact switch arm 100 of the contact switch 98 such that the battery charger 92 is turned on only when the step stool 10 is received within the opening 124 such that contacting engagement is made between the bands 82, 84 and the spring biased contacts 104, 106.

It should now be appreciated that, with the step stool 10 having a rechargeable battery 32 therein, the user may employ various lights, both stationary such as the lights 34, 36 or movable such as the light 38, to illuminate a work area of interest. The lights 34, 36 may be adjusted from horizontal to vertical, and any position in between, to illuminate, for example, the brakes of a car or its undercarriage and exhaust system. The lights are enabled by means of a motion switch 118 which energizes a timer switch 120 to allow for continued use of the lights during a period of time established by the timer switch 120. Each time the motion switch 118 is activated, the time period of the timer switch 120 is begun anew. Light emitting diodes 110 indicate sufficient contact engagement between the contacts 104, 106 and bands 82, 84 to effect the desired charging of the battery 32. In standard fashion, the charger 92 may be of the type that automatically terminates application of power to the output terminals of the charger when charging is complete. At such time, the light emitting diodes 110 will turn off, indicating that the battery 32 has been fully charged.

Not only does the step stool 10 provide desired positionable light for a work area, but it also continues to serve as a place on which a worker can sit or stand, as desired, to perform a work function. The lights are peripherally positioned so as not to interfere with that function.

In light of the foregoing, it should thus be evident that the structure of the present invention, provides a substantial improvement in the art. While the invention has been presented and described with regard to a step stool, the concept of the invention is not so confined. The invention extends to a transportable temporary light source that may be employed to illuminate any of numerous work areas, as small as the brake assembly on the wheel of an automobile, or as large as the interior of a building under construction. While, in accordance with the patent statutes, only the preferred embodiments of the present invention have been described in detail hereinabove, the present invention is not to be limited thereto or thereby. Rather, the scope of the invention includes all modifications and variations that fall within the scope of the attached claims.

What is claimed is:

1. A lighting device, comprising:

a step stool having a base and a support member carried by said base, wherein said base is supported off of a ground surface by retractable casters that, in the absence of sufficient force acting downwardly on the device, maintain said base off of a ground surface and permit the device to be rolled on said ground surface on said retractable casters, and, upon the application of sufficient force acting downwardly on the device, permit said base to contact said ground surface and prohibit movement on said retractable casters, said sufficient force being applied by a user stepping on said step stool;

a light source secured to said step stool to provide illumination at the exterior of said step stool;

a rechargeable battery maintained within said base and powering said light source by means of a wire running from the rechargeable battery to the light source, said light source being secured to said step stool at least by said wire;

a positive charging terminal band extending around the periphery of said base at the exterior thereof; and a negative charging terminal band extending around the periphery of said base at the exterior thereof.

2. The lighting device of claim 1, wherein said light source is secured to the device in a manner that permits selective positioning of a direction of illumination provided by said light source.

3. The lighting device of claim 2, wherein said light source is secured to a movable toothed cam that rotates relative to and selectively engages a stationary toothed cam at selective radial positions, and the rotation of said movable toothed cam rotates a direction of illumination of said light source in a first plane.

4. The lighting device of claim 3, wherein said stationary toothed cam is secured to the device through a movable post that rides on and rotates relative to a support post secured to said step stool, said rotation of said movable post rotating a direction of illumination of said light source in a second plane that is substantially normal to said first plane.

5. The lighting device of claim 1, further comprising:

a retracting spool; and a power cord wound about said retracting spool and connecting between said rechargeable battery and said light source.

6. The lighting device of claim 1, further comprising a timer switch interposed between said light source and said rechargeable battery, said timer switch enabling said light source for illumination by said power source for fixed periods of time.

7. The lighting device of claim 6, further comprising a motion switch connected to said timer switch, said motion switch activating said timer switch to commence one of said fixed periods of time upon movement of the device.

8. The lighting device of claim 1, wherein said light source comprises at least one fixed light secured to said support member in fixed position and orientation.

9. The lighting device of claim 8, wherein said at least one fixed light comprises a bank of fixed light for illuminating a work area.

10. A lighting device in combination with a charging station comprising:

a step stool having:

a base, a support member carried by said base, casters supporting said base off of a ground surface, a battery, a charging mechanism for said battery including a positive charging terminal band extending around the periphery of said base and a negative charging terminal band extending around the periphery of said base; and a charging station comprising:

a positive contact for contacting said positive charging terminal band; and a negative contact for contacting said negative charging terminal band, said charging station providing a receptacle for receipt of the device, said positive contact and negative contact contacting the respective terminal bands when the device is received by said receptacle, wherein the lighting device is received by said receptacle by being rolled into said receptacle on said casters.

11. The lighting device of claim 10, wherein said charging station further comprises a battery charger connected to said positive and negative contacts, and a first switch interposed between a power source and said battery charger and positioned in said receptacle, said first switch activating said charger upon receipt of the device by said receptacle.

12. The lighting device of claim 11, further characterized by indicator lights interposed between said charger and said battery, indicating a charging status of said battery.

13. The lighting device of claim 11, further comprising a second switch interposed among said contacts, said battery, and said light source, said second switch disconnecting said light source from said battery upon actuation of said first switch activating said charger.

14. The lighting device of claim 10, further comprising: wherein said casters are retractable casters that, in the absence of sufficient force acting downwardly on the device, maintain said base off of a ground surface so that the device may be moved by rolling on said ground surface on said retractable casters.

* * * * *